US009707979B2

(12) United States Patent
McMillen

(10) Patent No.: US 9,707,979 B2
(45) Date of Patent: Jul. 18, 2017

(54) TOP OPERATING H TIGHTLOCK COUPLER

(71) Applicant: McConway & Torley, LLC, Dallas, TX (US)

(72) Inventor: Richard G. McMillen, Pittsburgh, PA (US)

(73) Assignee: McCONWAY & TORLEY, LLC, Dallas, TX (US)

( * ) Notice: Subject to any disclaimer, the term of this patent is extended or adjusted under 35 U.S.C. 154(b) by 174 days.

(21) Appl. No.: 14/772,160

(22) PCT Filed: Mar. 13, 2014

(86) PCT No.: PCT/US2014/026433

§ 371 (c)(1),
(2) Date: Sep. 2, 2015

(87) PCT Pub. No.: WO2014/151779

PCT Pub. Date: Sep. 25, 2014

(65) Prior Publication Data

US 2016/0001797 A1 Jan. 7, 2016

Related U.S. Application Data

(60) Provisional application No. 61/793,963, filed on Mar. 15, 2013.

(51) Int. Cl.
*B61G 1/28* (2006.01)
*B61G 3/06* (2006.01)

(52) U.S. Cl.
CPC ..... *B61G 1/283* (2013.01); *B61G 3/06* (2013.01)

(58) Field of Classification Search
CPC ..... B61G 1/283; B61G 1/286; B61G 1/28; B61G 1/30; B61G 3/00; B61G 3/06; B61G 3/08
USPC ..... 213/75 R, 151, 152, 155, 109, 142
See application file for complete search history.

(56) References Cited

U.S. PATENT DOCUMENTS 4,363,414 A * 12/1982 Kaim ..... B61G 3/04 213/146
4,398,641 A * 8/1983 Klimowicz ..... B61G 3/06 213/109
5,927,522 A * 7/1999 Carifa ..... B61G 3/06 213/166
8,196,762 B2 * 6/2012 Smerecky ..... B22C 9/02 164/137
8,408,406 B2 * 4/2013 Smerecky ..... B61G 3/04 213/100 R (Continued)

*Primary Examiner* — Jason C Smith
(74) *Attorney, Agent, or Firm* — Baker Botts, LLP

(57) ABSTRACT

A system comprising a type H tightlock coupler comprising a channel and an inner chamber, the channel running from a top side of the type H tightlock coupler to the inner chamber, and an anti-creep shelf disposed on an interior surface of the inner chamber, a plug comprising a first surface operable to contact the anti-creep shelf, the plug configured to fit at least partially within the channel, a link comprising a second surface operable to contact the anti-creep shelf and a hook, the link configured to fit at least partially within the channel, and a lock comprising a slot operable to receive the hook, the lock configured to fit at least partially within the inner chamber.

20 Claims, 8 Drawing Sheets

(56) References Cited

U.S. PATENT DOCUMENTS

| | | | | |
|---|---|---|---|---|
| 8,662,327 | B2 * | 3/2014 | Nibouar | B22C 9/10 164/137 |
| 8,746,473 | B2 * | 6/2014 | Smerecky | B61G 3/06 213/119 |
| 8,770,265 | B2 * | 7/2014 | Nibouar | B22D 25/02 164/137 |
| 2009/0289021 | A1 * | 11/2009 | Smerecky | B61G 3/06 213/151 |
| 2016/0001797 | A1 * | 1/2016 | McMillen | B61G 1/283 213/178 |

* cited by examiner

TOP OPERATING H TIGHTLOCK COUPLER

PRIORITY INFORMATION

The present application is a U.S. National Stage Filing under 35 U.S.C. §371 of International Patent Application Serial No. PCT/US2014/026433 filed Mar. 13, 2014 and entitled "TOP OPERATING H TIGHTLOCK COUPLER" and claims benefit of U.S. Provisional Application Serial No. 61/793,963, filed Mar. 15, 2013, and incorporated by reference herein.

TECHNICAL FIELD

The present disclosure relates to a coupler for a rail car and in particular to systems and methods for using a top operating configuration in a type H tightlock coupler.

BACKGROUND OF THE INVENTION

The railroad industry uses a variety of technologies to facilitate moving rail cars. A coupler allows a locomotive to be coupled to an adjacent car. Similarly, couplers allow freight and passenger cars to be coupled to adjacent cars.

Couplers that fail to operate as designed may result in the de-coupling of rail cars while in use, which can create significant safety hazards for railroad customers and personnel as well as significant logistical problems. Further, couplers that are difficult to operate, that malfunction, or that fail to operate as designed may require greater involvement from industry personnel to couple and decouple adjacent cars, which can increase the risk of injury and death.

SUMMARY OF THE INVENTION

According to embodiments of the present disclosure, a system comprises a type H tightlock coupler comprising a channel and an inner chamber, the channel running from a top side of the type H tightlock coupler to the inner chamber, and an anti-creep shelf disposed on an interior surface of the inner chamber, a plug comprising a first surface operable to contact the anti-creep shelf, the plug configured to fit at least partially within the channel, a link comprising a second surface operable to contact the anti-creep shelf and a hook, the link configured to fit at least partially within the channel, and a lock comprising a slot operable to receive the hook, the lock configured to fit at least partially within the inner chamber.

Technical advantages of various embodiments may include reduced risk of wear and/or damage to a top operating lock lift assembly, reduced failure rates and/or improved operation of the top operating lock lift assembly, reduced manufacturing and/or maintenance costs, reduced risk of injury and/or death to rail industry personnel involved with the coupling and decoupling of rail cars, and/or other various advantages.

BRIEF DESCRIPTION OF THE DRAWINGS

For a more complete understanding of the present disclosure, its features and advantages, reference is now made to the following description, taken in conjunction with the accompanying drawings, in which.

DETAILED DESCRIPTION

Figure 1:
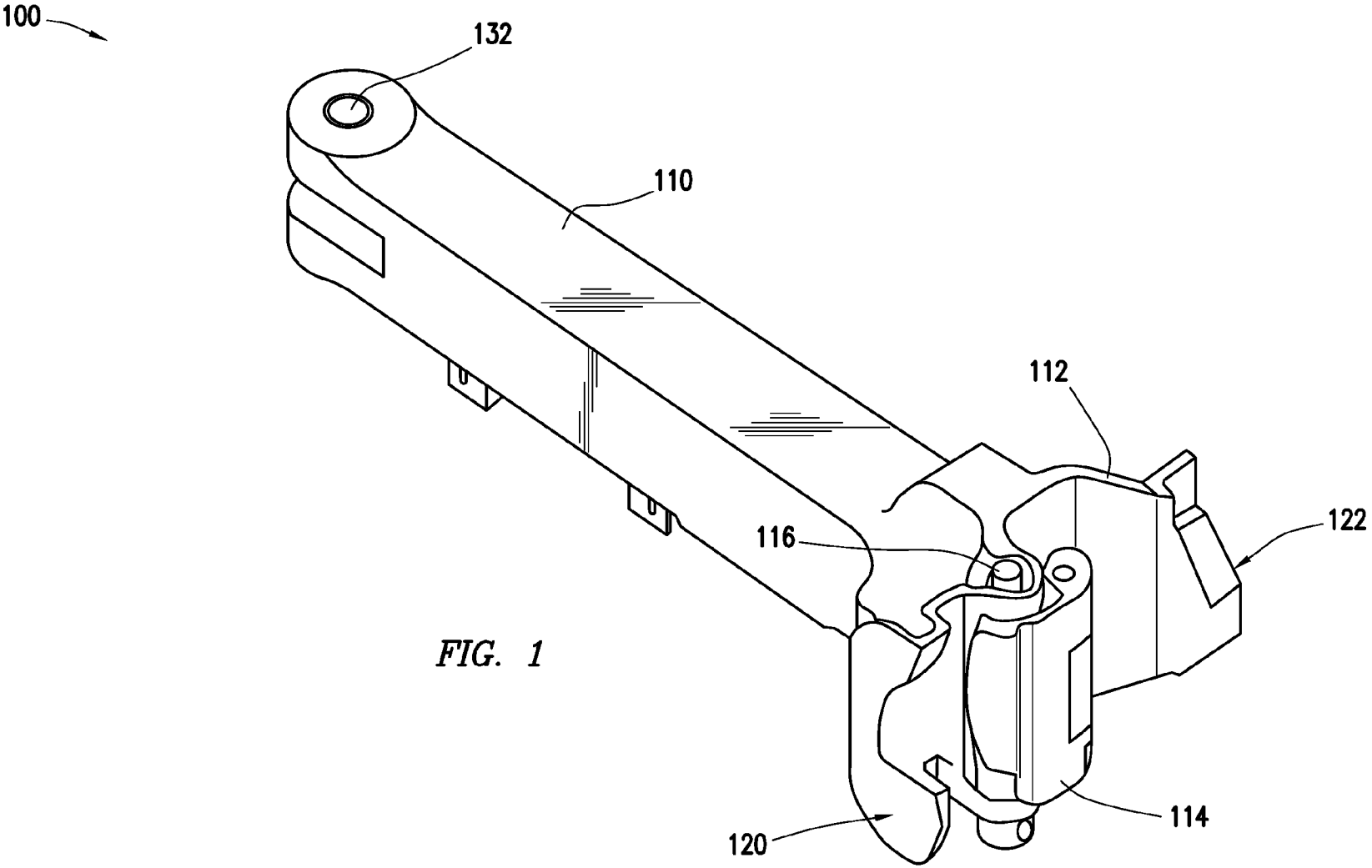
FIG. 1 illustrates a type H tightlock coupler in accordance with a conventional approach.

FIG. 1 illustrates a type H tightlock coupler 100 in accordance with a conventional approach. Type H tightlock coupler 100 comprises a shank 110, a head 112, a knuckle 114, and a knuckle pivot pin 116. Knuckle 114 is coupled to head 112 by pivot pin 116 on the knuckle-arm side 120 of head 112, opposite a guard arm side 122. Knuckle 114 may pivot generally about knuckle pivot pin 116 such that knuckle 114 may close (as illustrated) and open (not illustrated) in order to couple and decouple adjacent rail cars, respectively.

Type H tightlock coupler 100 comprises a channel 132. Channel 132 is located at the opposite end of shank 110 from head 112. Channel 132 may be used to facilitate coupling type H tightlock coupler 100 to other components, including, for example a radial connector, a yoke, a coupler carrier, draft gear, and/or a centering device.

Type H tightlock coupler 100 may be distinguished from a type E or type F coupler, or other couplers by the dimensional contour of coupler head 112, which is set forth by the Mechanical Committee of Standard Coupler Manufacturers. The contour of head 112 allows a reduction in slack, e.g. the amount of free movement of a particular car. Reducing slack between adjacent cars allows type H tightlock couplers to be used in applications where a rail operator may desire particular performance indicators. For example, type H tightlock couplers may be used to couple passenger cars in order to reduce objectionable shocks and/or noise often attributed to couplers.

Type H tightlock coupler 100 may include a variety of other components not visible in this illustration. For example, type H tightlock coupler 100 may include a lock that is operable to prevent knuckle 114 from opening during transit or during rest. In various embodiments, type H tightlock couplers may include a lock lift assembly, which includes one or more components operable to lift the lock within a chamber in the coupler head. Moving the lock within the chamber may allow the knuckle to move and thus couple or decouple an adjacent car. Conventional type H tightlock couplers typically employ bottom operating lock lift assemblies.

Figure 2:
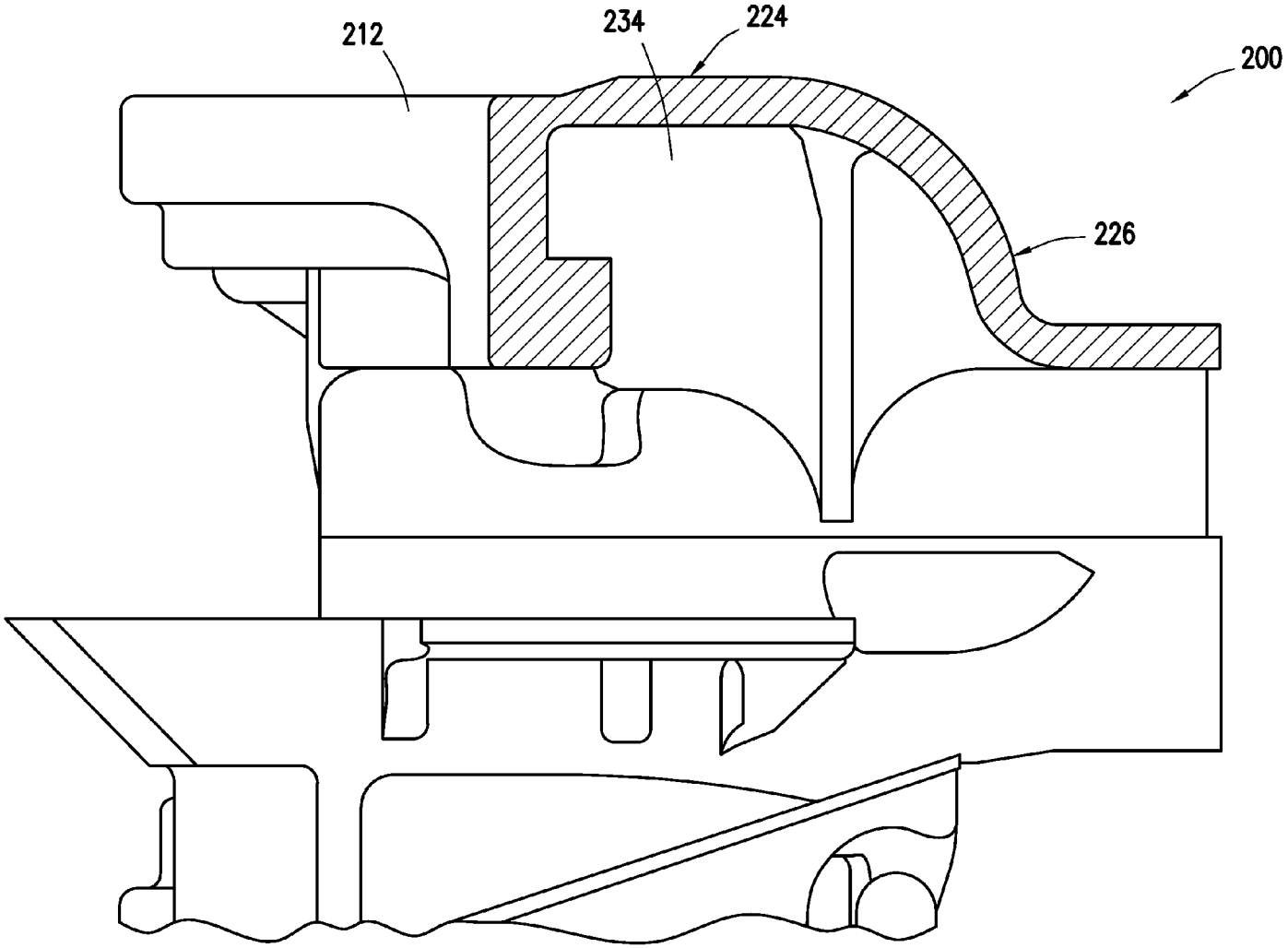
FIG. 2 illustrates a cut-away view of a type H tightlock coupler in accordance with a conventional approach.

FIG. 2 illustrates a cut-away view of a conventional type H tightlock coupler. Type H tightlock coupler 200 comprises a coupler head 212. Coupler head 212 comprises a chamber 234, an upper surface 224 and a back surface 226. Chamber 234 is formed in part by the interior surfaces of upper surface 224 and back surface 226. As is illustrated, the transition from upper surface 224 to back surface 226 includes a sloped portion. Chamber 234 has a corresponding, sloped interior surface.

Other conventional couplers, such as type E and type F couplers, have coupler heads and interior chambers that differ from the illustrated type H tightlock coupler in various regards. Type E and type F couplers, for example, include a generally more rectangular coupler head and, as a result, the transition between an upper surface and a back surface is more angular. Correspondingly, an interior chamber in a type E or type F coupler is more rectangular as well.

Similar to conventional type H tightlock couplers, type E and type F couplers often employ bottom operating lock lift assemblies. Certain type E and type F couplers may alternately employ a top operating lock lift assembly. The geometry of the type E and type F coupler heads facilitates the application of a top operating lock lift assembly in that the generally flat upper surface of these couplers easily allows for a channel necessary for a top operating lock lift assembly. Additionally, the angular dimensions of the head more easily allow for the inclusion of an anti-creep shelf. An anti-creep shelf is a surface that extends into an interior chamber of a coupler head that may prevent inadvertent movement of a lock lift assembly by limiting movement of one or more components of the assembly.

Conventional wisdom holds that type H tightlock couplers are ill-suited for top operating lock lift assemblies because the sloped dimensions of the type H tightlock coupler head make inclusion of a top channel and an anti-creep shelf within an interior chamber difficult and/or impossible. However, contrary to conventional wisdom, the teachings of the disclosure recognize that it is possible to use a top operating configuration with a type H tightlock coupler. FIGS. 3 through 7 illustrate this new approach. In various embodiments, a type H tightlock coupler may be configured to include a channel into an interior chamber and an anti-creep shelf within the interior chamber, as well as components for a lock lift assembly that include a surface or surfaces to interface with the anti-creep shelf. Departing from the traditional method and employing a top operating type H tightlock coupler may reduce risks of wear and/or damage to the lock lift assembly, may reduce failure rates and/or improve operation of the lock lift assembly, may reduce manufacturing and/or maintenance costs, may reduce risk of injury and/or death to rail industry personnel involved with the coupling and decoupling of rail cars, and may provide additional or alternative benefits.

Figure 3:
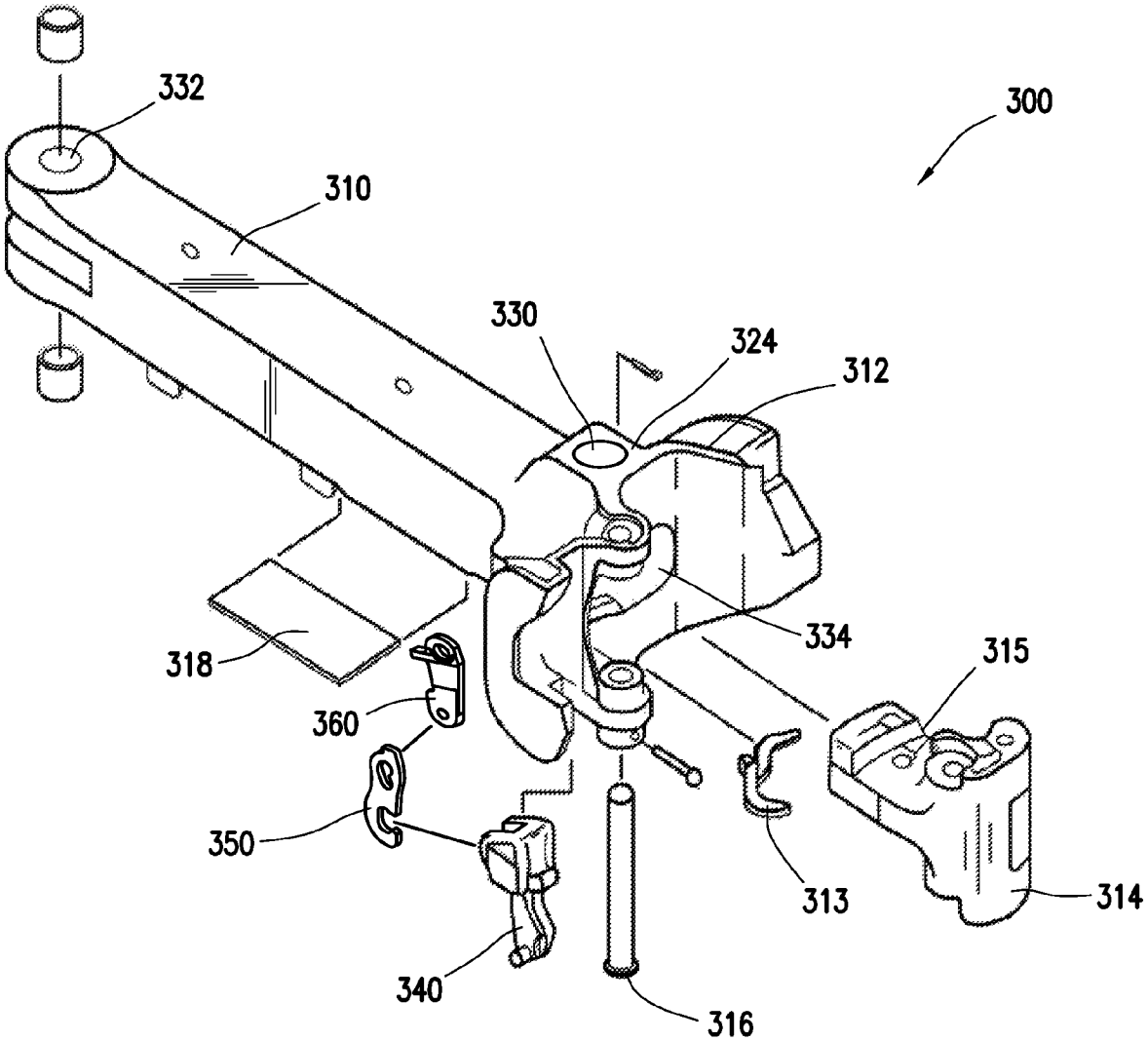
FIG. 3 illustrates a type H tightlock coupler in accordance with particular embodiments of the disclosure.

FIG. 3 illustrates a type H tightlock coupler in accordance with particular embodiments of the disclosure and includes an exploded view of a type H tightlock coupler 300. Type H tightlock coupler 300 comprises a shank 310, a head 312, a knuckle thrower 313, a knuckle 314, a knuckle tail 315, a knuckle pivot pin 316, a wear plate 318, a lock 340, a link 350, and a plug 360. Type H tightlock coupler also comprises a channel 330, a channel 332, and a chamber 334. Channel 330 is located on an upper surface 324 of head 312 and forms an opening into chamber 334. When coupler 300 is in use, upper side 324 faces skyward.

When type H tightlock coupler 300 is constructed, lock 340 is positioned essentially behind knuckle 314 within chamber 334. Link 350 and plug 360 together comprise a top operating lock lift assembly that is operable to lift lock 340 within chamber 334. Plug 360 is coupled to link 350 and link 350 is coupled to lock 340. To operate the top operating lock lift assembly when type H tightlock coupler 300 is constructed, plug 360, which is partially fitted within channel 330, is lifted upward from upper surface 324 causing link 350 to move upward from within chamber 334 into channel 330, which in turn, causes lock 340 to move upward within chamber 334. Lifting lock 340 within chamber 334 may cause knuckle thrower 313 to throw knuckle 314 open.

In various embodiments, type H tightlock coupler 300 may comprise additional components. For example, in various embodiments, coupler 300 may also include an operating mechanism that is operable to lift plug 360 upward within channel 330 so as to operate the lock lift assembly. Suitable operating mechanisms may comprise levers, rods, and/or a variety of other components. In various embodiments, the operating mechanism may be operated mechanically, electronically, or by hand. In particular embodiments, the operating mechanism may be intended to be operated mechanically or electronically, and may also be operated by hand.

Figure 4A:
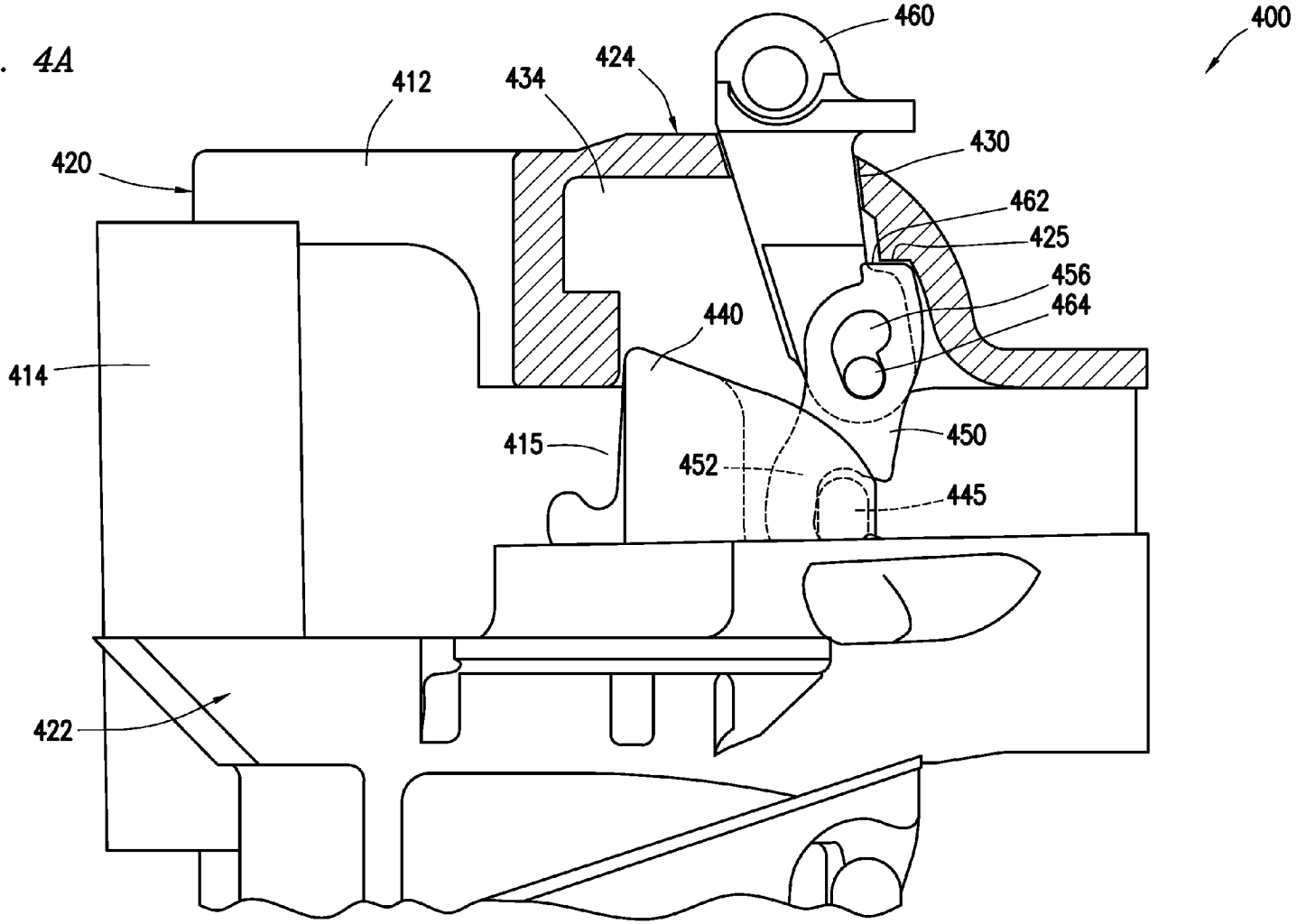
FIGS. 4A and 4B illustrate another type H tightlock coupler in accordance with particular embodiments of the disclosure.
Figure 4B:
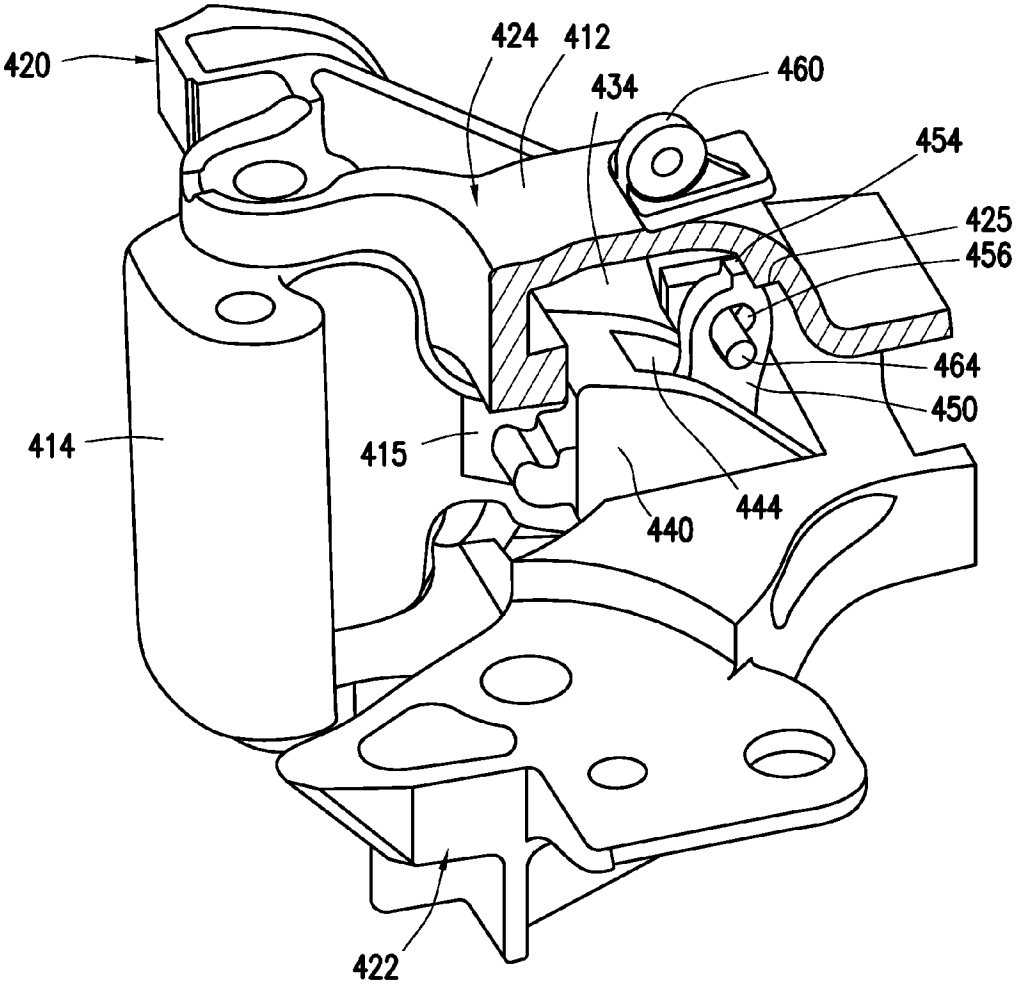

FIGS. 4A and 4B illustrate another type H tightlock coupler in accordance with particular embodiments of the disclosure. FIG. 4A illustrates a cut-away view of a type H tightlock coupler 400 that comprises a head 412, a knuckle 414, a knuckle arm side 420, a guard arm side 422, a top surface 424, an anti-creep shelf 425, a channel 430, and a chamber 434. Type H tightlock coupler 400 further comprises a lock 440 with a lock bar 445, and a top operating lock lift assembly, which includes a link 450, a link hook 452, a link channel 456, a plug 460, a plug ledge 462, and a plug pin 464. Accordingly, inside chamber 434 at the bottom of link 450, link 450 is coupled to lock 440 by hooking link hook 452 to lock bar 445. At the top of link 450, link 450 is also coupled to plug 460 by virtue of plug pin 464, which is inserted in link channel 456.

As illustrated, lock 440 and the lock lift assembly are illustrated in the closed or locked position. In the locked position, knuckle 414 is closed such that it will not decouple from an adjacent car if coupled or couple with an adjacent car if decoupled. In the locked position, lock 440 is located between one side of a knuckle tail 415 and an interior wall (not illustrated) of chamber 434 on the guard arm side 422. In various embodiments, lock 440 may be supported or seated partly on a support ledge of the knuckle tail and partly on a knuckle thrower (not illustrated).

In the locked position, plug 460 rests in part on upper surface 424 and extends through channel 430 into chamber 434. Anti-creep shelf 425 extends from the sloped portion of the interior surface of chamber 434 into chamber 434 and includes a bottom surface that is generally horizontal. In various embodiments, the anti-creep shelf may extend only from the top surface of chamber 434 or only from the back surface of chamber 434. In certain embodiments, anti-creep shelf 425 may or may not have any edges within chamber 434 and it may be larger or smaller than illustrated. Plug ledge 462 includes a generally horizontal surface that, in locked position, is opposite the bottom surface of anti-creep shelf 425. In the locked position, plug 460 may not be accidently pulled upward or bounce upward through channel 430 due to oscillations attributable to jostling, bumpiness, or other disturbances encountered during rail transit. Should type H tightlock coupler 400 encounter, for example, a bump during transit, plug 460 may be prevented from moving upward through channel 430 because plug ledge 462 will move upward and make contact with anti-creep shelf 425, which in turn prevents further upward movement of plug 460.

In particular embodiments, a longitudinal axis of channel 430 may be angled with respect to a line perpendicular to top surface 424. For example, as illustrated, channel 430 may angle slightly away from anti-creep shelf 425 and towards knuckle 414. When a generally upward force is exerted on plug 460, the angle of channel 430 may facilitate movement of plug 460 through channel 530 such that plug ledge 462 does not come into contact (or minimizes contact) with anti-creep shelf 425.

FIG. 4B illustrates another view of type H tightlock coupler 400 and includes a lock slot 444 and a link ledge 454. Link 450 comprises hook 452 (not illustrated) located at the bottom of link 450 and link ledge 454 located at the top of link 450. Link 450 is coupled to lock 440 by hook 452. In particular, when link 450 moves upward within chamber 434, hook 452 hooks, or catches, bar 445 within lock slot 444 located in the back of lock 440 and pulls lock 440 upward as well. Link ledge 454 is a generally horizontal surface that, in locked position, is opposite the bottom surface of anti-creep shelf 425. In this position, link 450 may not be accidently pulled upward or bounce upward through channel 430 (not illustrated) due to oscillations of a rail car as described above with respect to plug 460.

Link 450 is also coupled to plug 460 via plug pin 464. The bottom portion of plug 460 includes a channel or hole (not illustrated) that is adjacent to link channel 456. Plug pin 464 is inserted through these openings so as to couple link 450 and plug 460. In various embodiments, link 450 and plug 460 may be coupled together in any suitable fashion. In some embodiments, plug pin 464 may be integral with plug 460. In certain embodiments, link 450 and plug 460 may be one contiguous or jointed component. Further, in particular embodiments, plug 460 may be slotted, such that the bottom portion of plug 460 is configured to receive the upper portion of link 450 and is adjacent to both sides of the upper portion of link 450.

As described here, when top operating type H tightlock coupler 400 is in a locked configuration, both plug ledge 462 (not illustrated) and link ledge 454 may come into contact with anti-creep shelf 425 in order to prevent the upward movement of the lock lift assembly, which could move the lock from a locked position to a lockset or unlock position. Reducing the likelihood of inadvertently moving the lock into the lockset or unlock position may decrease or eliminate the chance of accidental and/or unanticipated decoupling of adjacent rail cars. The risk of unintended movement of the lock lift assembly may be further reduced by virtue of the location of the top operating configuration. For example, the coupler head may shield the plug from debris and other agents present on certain rail tracks that would otherwise have the potential to strike and/or move the plug.

Figure 5:
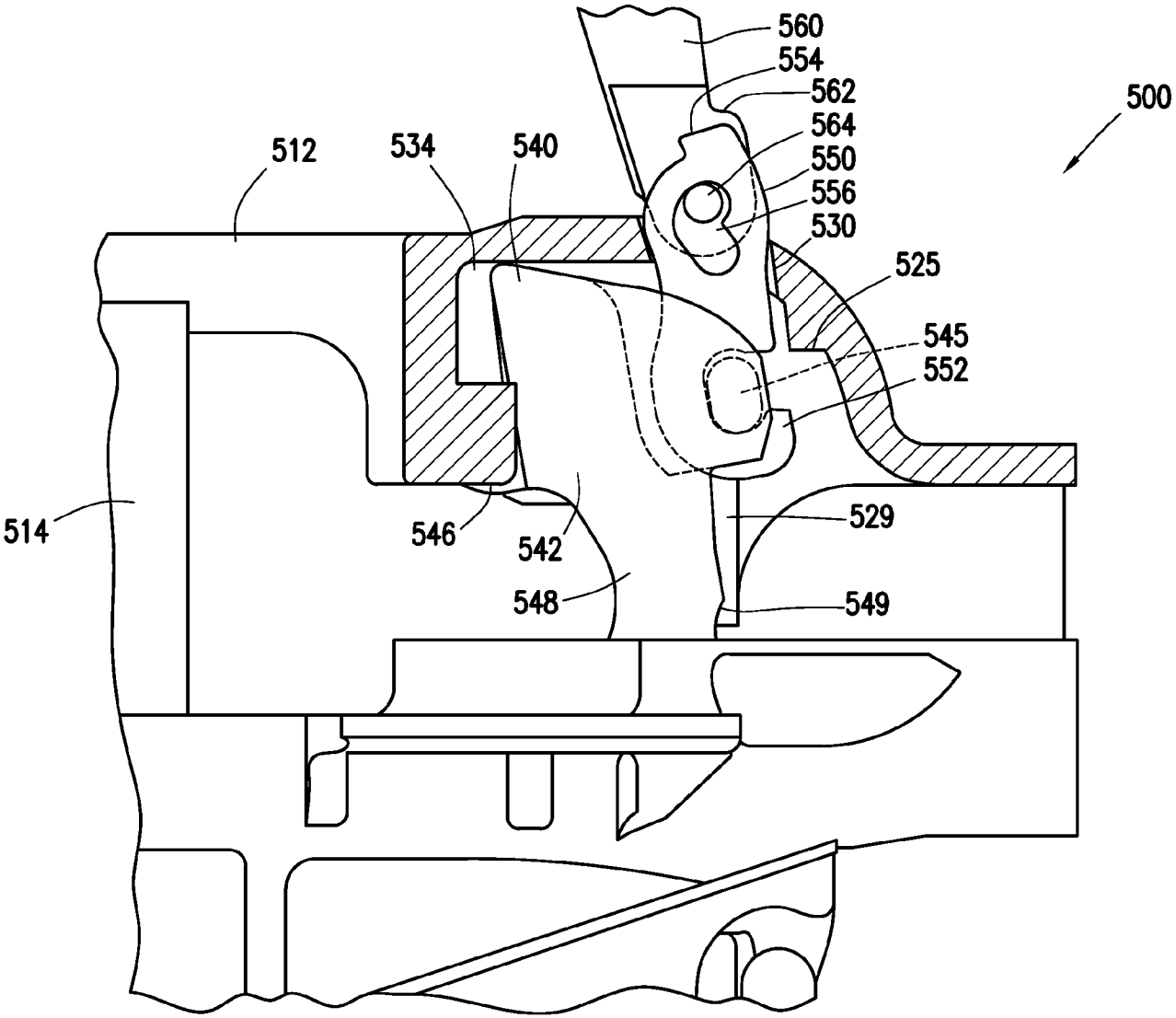
FIG. 5 illustrates another type H tightlock coupler in accordance with particular embodiments of the disclosure.

FIG. 5 illustrates another type H tightlock coupler in accordance with particular embodiments of the disclosure. FIG. 5 illustrates type H tightlock coupler 500 that comprises a coupler head 512, a knuckle 514, an anti-creep shelf 525, a guide rib 529, a channel 530, a chamber 534, a lock 540, a link 550, and a plug 560. Lock 540 comprises an upper lock body portion 542, a lock bar 545, a fulcrum 546 (partially illustrated), a leg portion 548, and a lock set seat 549. Link 550 comprises a hook 552, a link ledge 554, and a channel 556. Plug 560 comprises a plug ledge 562 and a plug pin 564.

Lock 540, as illustrated, is in an unlocked or open position. In the unlocked position, plug 560 has been pulled fully and link 550 has been pulled partially through channel 530. In order to pull plug 560 through channel 530 without engaging plug ledge 562 with anti-creep shelf 525 as described in conjunction with FIG. 4, plug 560 is pulled upward out of channel 530. In various embodiments, the hole located at the top of plug 560 is not centered over channel 530 (see FIG. 4A), thus, when a generally upward force is exerted via this hole in plug 560, plug 560 will move through channel 530 such that plug ledge 562 does not come into contact with anti-creep shelf 525. As plug 560 moves upward through channel 530, plug pin 564 will move from the bottom to the top of channel 556 in link 550. This movement causes link 550 to shift from a generally angled position with respect to plug 560 to a less angled, more in-line position, which allows link 550 to move through channel 530 with limited or no contact between link ledge 554 and anti-creep shelf 425. Because link 550 is coupled to lock 540 by lock bar 545, the upward force that moves plug 560 and link 550 through channel 530 also moves lock 540 upward within chamber 534. Guide rib 529 extends into chamber 534 from the knuckle side wall, starting at the top wall of chamber 534 and extending downward toward the bottom of the chamber. Guide rib 529 serves to limit lateral displacement of lock 540 in chamber 534 during its upward and downward travel.

In the unlocked position, upper lock body portion 542 is located in the upper-most portion of chamber 534. In this position, fulcrum 546 engages with a shoulder of a front wall of chamber 534. The continued application of an upward force causes lock 540 to rotate about fulcrum 546, driving leg portion 548 rearward in chamber 534. This shift in orientation of lock 540 also shifts the orientation of link 560. In particular, as lock 540 rotates about its fulcrum 546, lock bar 545 pushes hook 552 rearward in chamber 534, which may cause link 550 to pivot about plug pin 564, such that link ledge 554 moves away from plug ledge 562. In contrast, as discussed in conjunction with FIG. 4, when link ledge 554 and plug ledge 562 are located inside chamber 534, the ledges may be aligned and/or may both operate to prevent unintended movement of the lock lift assembly by engaging with anti-creep wall. In various embodiments, plug 560, link 550, and lock 540 may be coupled and/or configured in any suitable way such that lock 540 may be pulled upward and out of lock position.

In addition to the lock and unlock position described above, lock 540 may also be positioned in a lock set position (not illustrated). In the lock set position, upper body portion 542 is located at a mid-point within chamber 534, e.g., between its locked and unlocked position. Lock set seat 549 rests on a top surface of a knuckle thrower (not illustrated). Knuckle 514 may revolve about a knuckle pin (not illustrated) such that knuckle 514 may swing into an open position, for example, when a nose, or front, of an adjacent, coupled knuckle exerts a forward pull as its corresponding rail car pulls away. When lock 540 is moved from the lock set position to the unlock position by an upward force exerted by link 550, leg 548 engages the knuckle thrower and causes it to rotate. This rotation produces movement of knuckle 514 about the knuckle pin into the open position, so as to allow for decoupling of an adjacent car. Conversely, in various embodiments, when knuckle 514 moves from an open to a closed position, lock 540 will drop due to gravity from the unlocked or lock set position to the lock position and lock knuckle 514 in place as described in conjunction with FIGS. 4A and 4B. Utilizing a top operating lock lift assembly in a type H tightlock coupler may improve coupling and decoupling by reducing the incidence of malfunctioning components and/or by reducing the time required to move a lock into a desired position. In addition, utilizing a top operating lock lift assembly may be more convenient for rail personnel or other operators who are in a corresponding rail car. A bottom operating assembly, in contrast, may require personnel to exit the rail car in order to access the assembly.

Figure 6B:
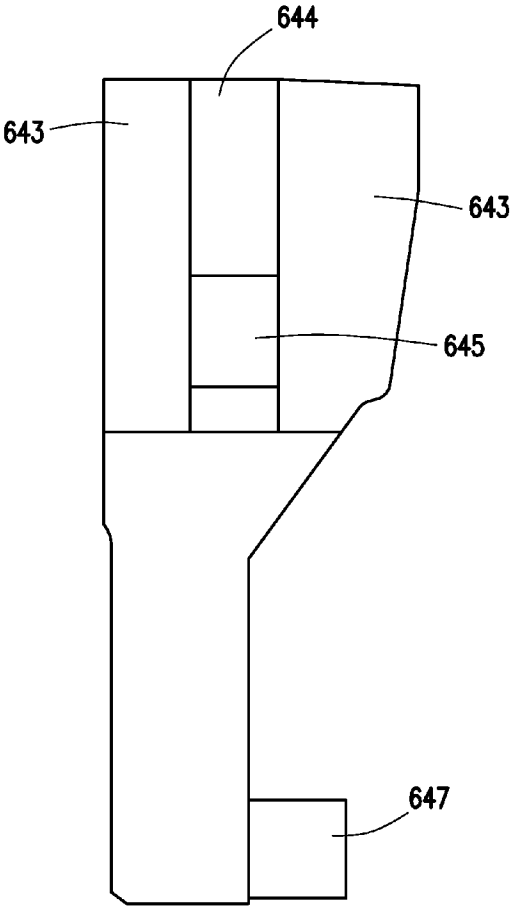
FIGS. 6A and 6B illustrate a lock in accordance with particular embodiments of the disclosure.
Figure 6A:
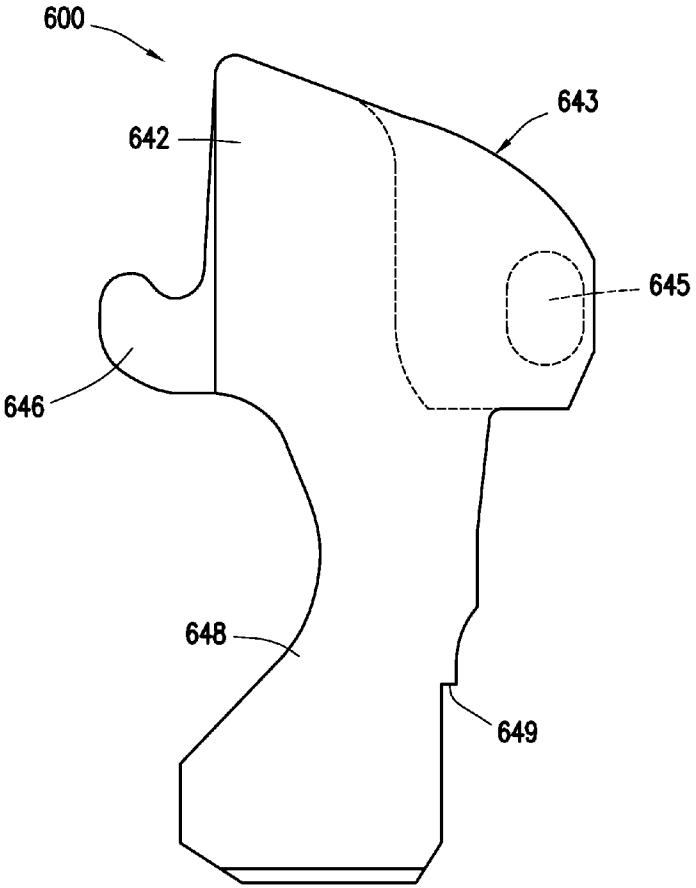

FIGS. 6A and 6B illustrate a lock in accordance with particular embodiments of the disclosure. Lock 600 comprises an upper body portion 642 and a leg portion 648. Upper body portion 642 comprises back portions 643, a slot 644, a lock bar 645, and a fulcrum 646. Leg 648 comprises a protrusion 647 and a lock set seat 649.

To work with a top operating lock lift assembly for a type H tightlock coupler, lock 600 must be modified from the locks conventionally used in type H tightlock couplers. In particular, lock 600 is modified to include slot 644 and lock bar 645. Slot 644 is an open channel formed between back portions 643. Within slot 644, lock bar 645 extends from one back portion 643 to another back portion 643. As discussed in conjunction with FIGS. 4A, 4B, and 5, lock bar 645 is configured to allow a hook to couple a lock lift assembly to lock 600. In various embodiments, the slot may omit the bar and alternately include a surface operable to receive and couple a link hook. In certain embodiments, the slot may occupy a greater or lesser portion of the upper body portion of lock 600.

Other features of lock 600 may facilitate improved and/or optimal deployment of the top operating lock lift assembly. For example, fulcrum 646 allows for additional pivoting by lock 600 and/or the link coupled to lock 600. Protrusion 647 allows lock 600 to rest on a knuckle thrower during lock set as described in conjunction with FIG. 5. In certain embodiments, lock 600 may include additional or alternate features. In various embodiments, lock 600 may be further modified to alter or improve its performance within a type H tightlock coupler with a top operating configuration.

Figure 7B:
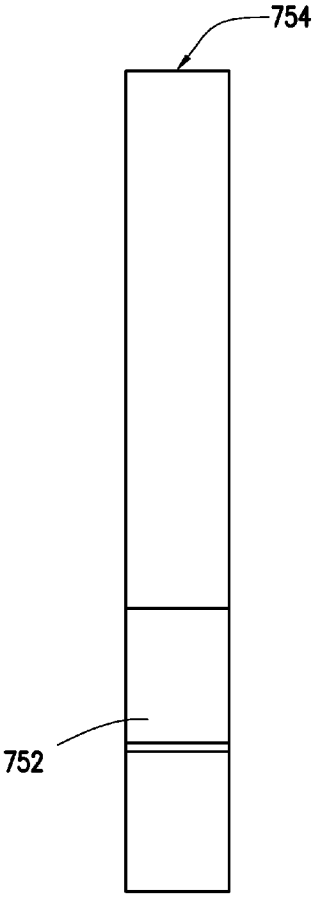
FIGS. 7A and 7B illustrate a link in accordance with particular embodiments of the disclosure.
Figure 7A:
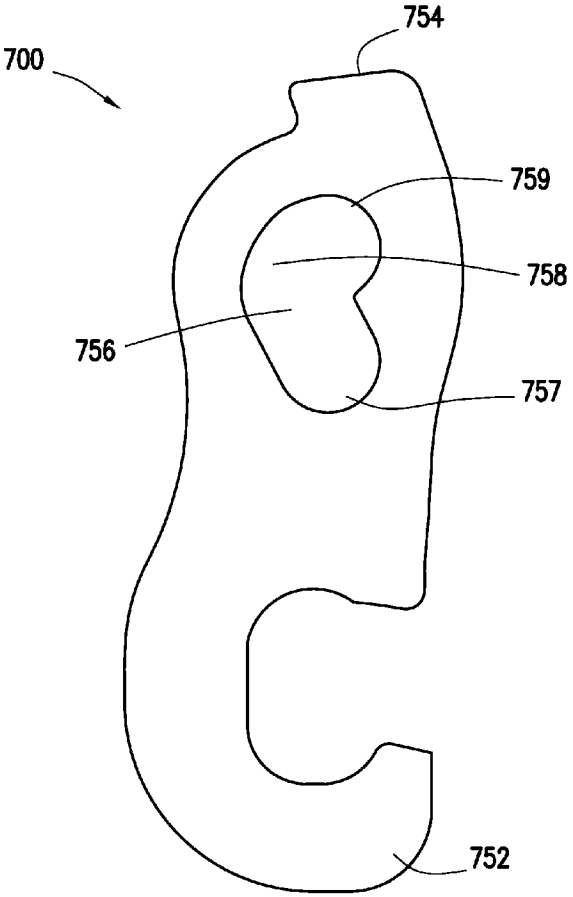

FIGS. 7A and 7B illustrate a link in accordance with particular embodiments of the disclosure. Link 700 comprises a hook 752, a link ledge 754, and a channel 756. Channel 756 includes generally circular portions 757 and 759, and a joining portion 758.

To work with a top operating lock lift assembly for a type H tightlock coupler, link 700 had to be modified from the links conventionally used in type H tightlock couplers. In particular, the dimensions of link 700 were altered. For example, in certain embodiments, the length of link 700 was reduced in comparison to type E and type F links in order to allow use within a chamber of a type H tightlock coupler. Hook 752 allows link to couple and to lift a lock as described in conjunction with FIGS. 4A, 4B, 5, 6A and 6B. Link ledge 754 may engage with an anti-creep shelf within a coupler head to reduce the chance of inadvertent lock lift assembly operation and/or resulting decoupling. Channel 756 is operable to receive a pin in order to couple link 700 with a plug as discussed in conjunction with FIGS. 3, 4A, 4B, and 5. Channel 756 is an irregular shape and includes two generally circular portions 757 and 759 connected by a joining portion 758. Channel 756 permits link 700 to move about a coupling pin within a lock lift assembly. For example, when link 700 is in lock position, the coupling pin is located in portion 757. As a plug in the lock lift assembly moves upward, the coupling pin will move from portion 757 to portion 758 and then to portion 759. The movement of the coupling pin within channel 756 allows lock 700 to move from a generally angled position with respect to the plug in the lock lift assembly, to a generally less angled, more in-line position. This movement helps to ensure that link ledge 754 does not engage with the anti-creep shelf within the coupler head. This additional mobility may also increase various other performance characteristics in a type H tightlock coupler with a top operating configuration. In various embodiments, any or all of these three portions are sized sufficiently to receive a pin for coupling. In certain embodiments, channel 756 may be any suitable size or shape. In certain embodiments, link 700 may include additional or alternate features. In various embodiments, lock 700 may be further modified to alter or improve its performance within a type H tightlock coupler with a top operating configuration.

Contrary to conventional thinking, this disclosure evidences that it is possible to overcome the challenges associated with deploying a top operating lock lift assembly within a type H tightlock coupler. Despite the sloped dimensions of the type H coupler head, it is possible to include a channel for top operating components and an anti-creep shelf. Further, it is possible to modify various components of a type H coupler, in particular a plug, link, and/or lock, in order to utilize a top operating configuration. Technical advantages of using a top operating type H tightlock coupler may include reduced risk of wear and/or damage to the lock lift assembly, reduced failure rates and/or improved operation of the lock lift assembly, reduced manufacturing and/or maintenance costs, reduced risk of injury and/or death to rail industry personnel involved with the coupling and decoupling of rail cars, or other advantages. Additional and/or alternative advantages may include various direct or indirect economic benefits, for example reduced worker compensation costs, various reputational benefits associated with a smoother, quieter, or more enjoyable ride for passengers, and/or various logistical benefits associated with more reliable coupling and decoupling of rail cars, and in particular, passenger rail cars. Top operating type H tightlock couplers may also satisfy rail industry demand based on safety concerns and convenience interests for a top operating system that does not require rail personnel to dismount a rail car to operate the system.

Although the present invention has been described in detail with reference to particular embodiments, it should be understood that various other changes, substitutions, and alterations may be made hereto without departing from the spirit and scope of the present invention. For example, although particular embodiments of the disclosure have been described with reference to a number of elements included within a top operating type H tightlock coupler, these elements may be combined, rearranged or positioned in order to accommodate particular requirements or needs. For instance, the anti-creep shelf may be larger or smaller or situated at any suitable location within the chamber of the coupler head. In particular embodiments, the coupling between various components such as the plug and link or link and lock may be configured differently. Further, in certain embodiments, the lock lift assembly may be configured differently within the chamber of the coupler head. Various embodiments contemplate great flexibility in the arrangement of the lock lift assembly and other components.

What is claimed is:

1. A railway car coupler system, comprising:

a coupler head comprising:

a channel and an inner chamber, wherein the channel runs from a top side of the coupler head to the inner chamber; and an anti-creep shelf disposed on an interior surface of the inner chamber;

a plug comprising a first surface operable to contact the anti-creep shelf, wherein the plug is configured to fit at least partially within the channel;

a link comprising a second surface operable to contact the anti-creep shelf and a hook, wherein the link is configured to fit at least partially within the channel; and a lock comprising a slot operable to receive the hook, wherein the lock is configured to fit at least partially within the inner chamber and the link is configured to couple the lock to the plug.

2. The railway car coupler system of claim 1, wherein the coupler head comprises a type H tightlock coupler head.

3. The railway car coupler system of claim 1, wherein the anti-creep shelf comprises a bottom surface that is generally horizontal.

4. The railway car coupler system of claim 1, wherein the lock comprises a lock bar disposed within the slot and the hook is operable to catch on the lock bar.

5. The railway car coupler system of claim 1, wherein:

the plug comprises a plug pin;

the link comprises a link channel positioned opposite the hook and configured to receive the plug pin; and wherein the plug pin and the link channel are operable to couple the plug to the link.

6. The railway car coupler system of claim 1, comprising a guide rib disposed in the internal chamber and configured to limit lateral displacement of the lock as the lock moves up and down.

7. The railway car coupler system of claim 1, wherein the lock comprises a fulcrum configured to engage with a front wall of the inner chamber.

8. The railway car coupler system of claim 1, wherein a longitudinal axis of the channel is angled with respect to a line perpendicular to the top side of the coupler head.

9. The railway car coupler system of claim 1, wherein the plug comprises a receiver configured to receive a lifting mechanism operable to lift the plug in the channel, and wherein the receiver is offset from a centerline of the channel.

10. The railway car coupler system of claim 9, comprising:

a lifting mechanism coupled to the receiver and operable to lift the plug in the channel; and wherein the lifting mechanism is at least one of:

mechanical;

electrical; and manual.

11. A method, comprising:

coupling a first railcar coupler to a second railcar coupler of an adjacent railcar, wherein the first railcar coupler comprises:

a coupler head comprising:

a channel and an inner chamber, wherein the channel runs from a top side of the coupler head to the inner chamber; and an anti-creep shelf disposed on an interior surface of the inner chamber;

a plug comprising a first surface operable to contact the anti-creep shelf, wherein the plug is configured to fit at least partially within the channel;

a link comprising a second surface operable to contact the anti-creep shelf and a hook, wherein the link is configured to fit at least partially within the channel; and a lock comprising a slot operable to receive the hook, wherein the lock is configured to fit at least partially within the inner chamber and the link is configured to couple the lock to the plug.

12. The method of claim 11, wherein coupling a first railcar coupler to a second railcar coupler of an adjacent railcar comprises:

lowering the plug at least partially into the channel of the coupler head.

13. The method of claim 11, comprising de-coupling the first railcar coupler from the second railcar coupler of the adjacent railcar.

14. The method of claim 13, wherein de-coupling the first railcar coupler from the second railcar coupler of the adjacent railcar comprises:

raising the plug at least partially out of the channel of the coupler head.

15. The method of claim 11, wherein the first railcar coupler comprises a type H tightlock coupler.

16. The method of claim 11, wherein:

the plug comprises a plug pin;

the link comprises a link channel positioned opposite the hook and configured to receive the plug pin; and wherein the plug pin and the link channel are operable to couple the plug to the link.

17. The method of claim 11, wherein the first railcar coupler comprises a guide rib disposed in the internal chamber and configured to limit lateral displacement of the lock as the lock moves up and down.

18. The method of claim 11, wherein the lock comprises a fulcrum configured to engage with a front wall of the inner chamber.

19. The method of claim 11, wherein a longitudinal axis of the channel is angled with respect to a line perpendicular to the top side of the coupler head.

20. The method of claim 11, wherein the plug comprises a receiver configured to receive a lifting mechanism operable to lift the plug in the channel, and wherein the receiver is offset from a centerline of the channel.

* * * * *